United States Patent [19]

Homan

[11] Patent Number: 4,802,677

[45] Date of Patent: Feb. 7, 1989

[54] GAME ARROW

[76] Inventor: Jerald M. Homan, 343 Oakwood Ave., East Peoria, Ill. 61611

[21] Appl. No.: 100,408

[22] Filed: Sep. 24, 1987

[51] Int. Cl.[4] ..... F41B 15/00

[52] U.S. Cl. ..... 273/416

[58] Field of Search ..... 273/416–423; 124/5

[56] References Cited

U.S. PATENT DOCUMENTS

| | | | |
|---|---|---|---|
| 876,324 | 1/1908 | Brucker | 273/416 X |
| 1,907,273 | 5/1933 | Umling | 273/416 X |
| 1,999,601 | 4/1935 | Tengel | 273/416 |
| 2,182,951 | 12/1939 | Sweetland | 273/416 |
| 2,816,765 | 12/1957 | Stockfleth | 273/421 |
| 3,085,560 | 4/1963 | Peters | 273/416 X |
| 3,150,875 | 9/1964 | Searles | 273/418 |
| 4,204,307 | 5/1980 | Pfetzing | 273/423 X |
| 4,722,531 | 2/1988 | Schram | 273/416 |

FOREIGN PATENT DOCUMENTS

| | | | |
|---|---|---|---|
| 2443852 | 8/1980 | France | 273/416 |
| 2007514 | 5/1979 | United Kingdom | 273/416 |

*Primary Examiner*—Paul E. Shapiro

*Attorney, Agent, or Firm*—Ralph E. Walters

[57] ABSTRACT

A game arrow and is specifically concerned with providing a game arrow which is adapted to be launched by a hand held whip-like wand and string assembly which is substituted for the conventional bow and arrow. Such bow and arrow assemblies require a great amount of strength by the shooter in order to flex the bow sufficiently to provide a sufficient shooting force. This problem is overcome by the game arrow and launching device of the present invention which is able to launch an arrow by a movement similar to that employed when shooting a slingshot which does not require even a fraction of the amount of strength necessary for shooting a conventional bow and arrow. Furthermore, attempts to provide a slot in a conventional wooden arrow have not been successful because of the substantial weakening of the shaft of the arrow by the slot which frequently cannot withstand even the slightest shock forces during normal use. This problem is overcome by the present invention in its provision of a slot forming ferrule disposed between a two-piece arrow which provides added strength in this critical area and, in addition, provides a shock absorber for cushioning the normal impact forces encountered by the arrow when striking relatively impenatrable target objects, and the like.

4 Claims, 1 Drawing Sheet

GAME ARROW

TECHNICAL FIELD

The present invention relates to a game arrow and more particularly to such an arrow utilized in an arrow shooting game in which the arrow is adapted to be launched by a hand held whip-like wand and string assembly which is substituted for the conventional bow.

BACKGROUND ART

A form of arrow shooting game heretofore not commercially available has been known and used in some isolated areas for sometime. This little known arrow shooting game utilizes a homemade flipping device for launching a somewhat modified arrow through the air at predetermined randomly selected targets. Unlike a conventional bow and arrow, such homemade device employs an elongated wand or rod-like stick having a handle end and an opposite end to which a string is permanently attached. The string is approximately the same length as the stick and is knotted at its opposite free end. A thin slot is angularly cut in the arrow approximately midway of its ends for slideably receiving the string therethrough until engagement of its knotted end with the side of the arrow. Prior to launch, the shooter grasps the feathered end of the arrow in order to draw it back in tensioning relation to the string and the arrow is launched by a flipping motion of the stick in a manner similar to that used with a slingshot which does not require even a fraction of the strength necessary when shooting a conventional bow and arrow. One difficulty with such homemade arrow shooting device, however, has been the undesirable weakening of the arrow in the area of the string receiving slot. The hardwood from which conventional arrows are manufactured is very brittle with a tendency to split or splinter when striking a relatively hard impenatrable target object. The enherent brittleness of conventional arrows also frequently presents a problem when attempting their removal from a target which sometimes cannot be performed without considerable bending and twisting. This can result in the arrow breaking off leaving the pointed tip embedded in the target object. With further weakening of the arrow by slotting the shaft of the arrow, as utilized with the homemade shooting game, a predetermined certain break point is provided even should the arrow be accidently dropped or twisted during ordinary use and engagement with even the more penetrable target objects. Therefore, in order to develop a commercial version of the homemade arrow shooting game, it is desirable and necessary to design an improved arrow which is able dependably to resist breakage when subjected to the hazards of ordinary use and particularly to the special hazards presented when striking relatively hard impenatrable objects and the like. Accordingly, the present invention is directed to overcoming the problems as set forth above.

DISCLOSURE OF THE INVENTION

In accordance with one aspect of the present invention, there is provided a game arrow for use with a hand held arrow launching device having an elongated rod-like wand to which a knotted string is attached and a separable slot forming member is positioned within the shaft of the arrow approximately midway its ends for initially slideably receiving the string therethrough prior to launching with the slot being effective to automatically release the string as the arrow is propelled past the wand.

BEST MODE FOR CARRYING OUT THE INVENTION

Figure 1:
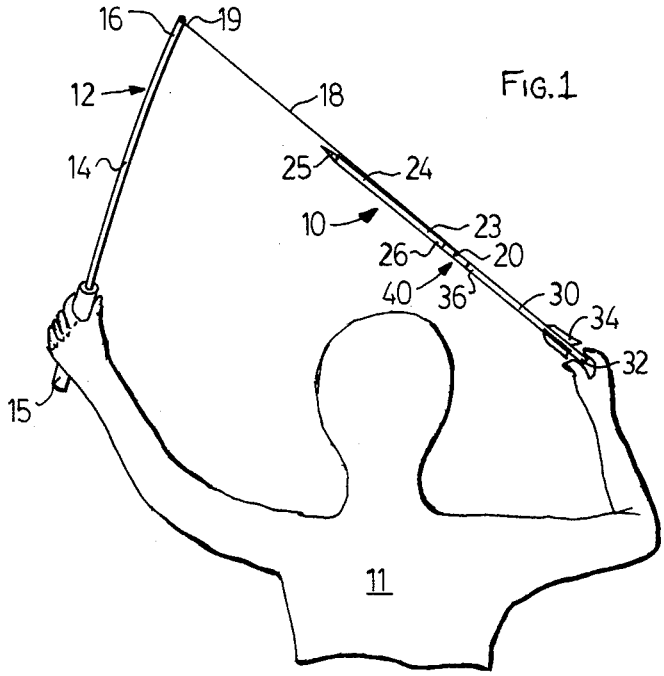
FIG. 1 is a three dimensional view of a game arrow embodying the principles of the present invention shown in connection with a launching device held by a shooter in a cocked pre-launch position.

As best shown in FIG. 1 of the drawing, a game arrow embodying the principles of the present invention is generally indicated by the reference numeral 10. The arrow is adapted to be propelled through the air by a shooter 11 with the aid of a hand held whip-like arrow launching device generally indicated by the reference numeral 12. The launching device includes an elongated substantially rigid somewhat flexible rod-like stick or wand 14 having a handle gripping end 15 and an opposite distal end 16. An elongated flexible string 18, which is approximately the same length as the wand, provides a connector end 19 which is firmly attached to the distal end of the wand and an opposite free-end 20 which is tied into an enlarged knot 21.

The game arrow 10 of the present invention is constructed having a two-piece shaft 23 manufactured of suitable hardwood material similar to a conventional arrow. The shaft has a predetermined forward portion 24 provided with a conventional pointed tip 25 and has an opposite connector end 26. The connector end has projected therefrom a reduced diameter stepped end 27 turned to a diametrical dimension somewhat less than the diameter of the shaft to provide an annular shoulder 28 therebetween.

The shaft 23 further includes a rearward portion 30 having a finger gripping end 32 which mounts a plurality of conventional flight stabilizing feathers 34. The rearward portion of the shaft also provides an opposite connector end 36 having a reduced diameter stepped end 37 which forms an annular shoulder 38 similar to the shoulder 28 of the forward portion 24 of the shaft.

Figure 2:
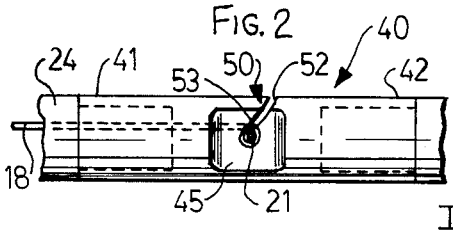
FIG. 2 is a somewhat enlarged side elevational view of a slot forming ferrule disposed substantially midway the ends of the arrow.
Figure 3:
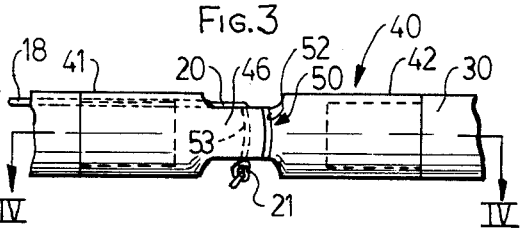
FIG. 3 is a somewhat enlarged top plan view of the ferrule and connecting shaft portions of the arrow of FIG. 2.
Figure 4:
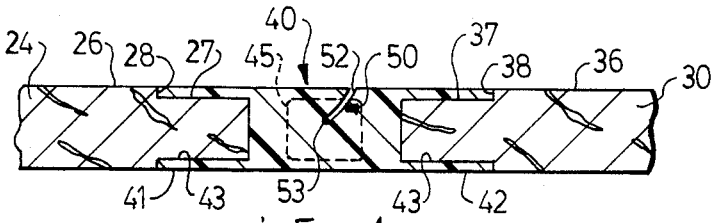
FIG. 4 is a substantially upright vertical cross-section through the ferrule and connecting shaft portions taken along the line IV—IV of FIG. 3.

A shaft connector member or slot forming ferrule 40 is provided substantially midway between the ends of the game arrow 10 for providing additional strength in this critical area. The ferrule is of the same diameter as the shaft 23 and is constructed of a relatively stronger but lightweight plastic material less subject to splitting or shattering and having greater impact resistance than the hardwood of the shaft. The ferrule includes opposite front and rear ends 41 and 42, respectively which are individually provided with oppositely opening blind bottomed bores 43. A pair of opposite side flats 45 are formed in the ferrule substantially midway between its opposite ends and have a vertical height, as viewed in FIG. 2 of somewhat less than the diameter of the ferrule to leave a pair of arcuate peripheral segments 46 therebetween.

A string receiving slot generally indicated by the reference numeral 50 is formed in the ferrule 40 and has an outer string entry end 52 disposed in the peripheral segment 46 at a position somewhat closer to the rearward end 42 of the ferrule. The slot extends arcuately inwardly of the ferrule and is generally extended toward the forward end 41 thereof and terminates in an inner bottom end 53 substantially centrally of the opposite side flats 45. The slot is of a width somewhat larger than the diameter of the string 18 for permitting free sliding movement of the string therethrough.

INDUSTRIAL APPLICABILITY

In use, the game arrow 10 and the wand and string assembly 14–18 are held in substantially parallel relation in one hand of the shooter 11. The free end 20 of the string is then grasped by the other hand of the shooter and is strung through the slot 50 of the ferrule 40. The finger gripping end 32 of the arrow is then grasped by the fingers of such other hand of the shooter and the arrow drawn back to the string tensioning pre-launch position of FIG. 1. During such positioning, the free end 20 of the string is permitted to slide through the slot 50 until the knot 21 engages its associated flat 45 on the ferrule. This causes the string to be tightly wedged against the bottom end 53 of the slot in dependable interconnecting relation between the string and the arrow. Further drawing back of the arrow causes it to assume a substantially parallel position with respect to the string which will also produce a slight amount of flexing of the wand 14. In the above-described pre-launch position the arms of the shooter 11 are simultaneously movable while maintaining the desired tensioning between the arrow string and wand for accurately aligning the arrow with a desired trojectory toward a target object, not shown. Both of the shooters arms are then moved simultaneously in the same forward direction in a manner very similar to that employed when shooting a slingshot for launching the game arrow 10. Upon release of the finger gripping end 32 of the arrow, the free end 20 of the string 18 will relax and be permitted to slide freely upwardly through the arcuate slot 50 and to be automatically discharged therefrom as the arrow is propelled past the distal end 16 of the wand. If at the end of the arrow's flight it should strike some impenatrable object, the shock forces therefrom will be substantially absorbed by the somewhat resilient ferrule 40 and will be effective to resist any splitting or breaking of the arrow in such normally vulnerable slotted portion of the arrow shaft.

In view of the foregoing it is readily apparent that the present invention provides an improved game arrow by the addition of the arcuate slot forming ferrule disposed intermediate the ends of the shaft of the arrow which not only provides additional strength in this otherwise vulnerable area but further serves as a cushioning device for absorbing the shock forces of impact along the entire length of the shaft. The side flats on the ferrule adjacent to the slot further provide a non-slip surface against which the knotted end of the string is permitted to more tightly engage than would be the case with a conventional arcuately formed surface of a conventional round arrow. The arcuately formed slot is effective to better retain the knotted end of the string upon tensioning during pre-launch and is also effective to automatically release the string as the arrow is propelled past the launching wand.

I claim:

1. A game arrow, for use with a launching device providing an elongated substantially rigid somewhat flexible stick having a handle end and an opposite distal end with an elongated string attached thereto with the string having an opposite knotted end, comprising;

a two-piece shaft having a forward portion providing a forward end and an opposite connector end, and a rearward portion providing a finger gripping end and an opposite connector end;

and an elongated ferrule having opposite ends rigidly interconnecting said connector ends of the shaft and a mid-portion provided with opposite flats with opposite peripherally curved segments therebetween;

and a slot extended inwardly of the ferrule through one of said segments between said flats of a width slideably to receive said string therethrough with said knotted end of the string engageable with one of said flats.

2. The game arrow of claim 1 in which said ferrule includes opposite forward and rearward ends corresponding to said forward and rearward portions of the shaft;

and said slot having an outer entry end disposed more closely adjacent to said rearward end of the ferrule with the slot being inwardly extended therefrom to terminate in an inner end disposed more closely adjacent to said forward end of the ferrule.

3. The game arrow of claim 2 in which said slot is arcuately curved between its outer and inner ends.

4. The game arrow of claim 3 wherein said shaft is constructed of a relatively hardwood;

and said ferrule is constructed of a relatively lightweight stronger less brittle material different than the material of said shaft.

* * * * *